US005191995A

United States Patent [19]

McDonald

[11] Patent Number: 5,191,995

[45] Date of Patent: Mar. 9, 1993

[54] GOLF BALL STORAGE AND DISPENSING DEVICE

[76] Inventor: Gayle McDonald, 151 W. 5275 South, Murray, Utah 84107

[21] Appl. No.: 819,998

[22] Filed: Jan. 13, 1992

[51] Int. Cl.[5] ..... B65G 59/00

[52] U.S. Cl. ..... 221/24; 221/227; 221/231; 221/232; 221/266; 221/281

[58] Field of Search ..... 221/24, 227, 229, 231, 221/232, 266, 279, 281

[56] References Cited

U.S. PATENT DOCUMENTS

| | | | |
|---|---|---|---|
| 1,810,491 | 6/1931 | McClure | 221/279 |
| 1,844,285 | 2/1932 | Johnson | 221/279 |
| 2,443,861 | 6/1948 | Johnston | 221/232 |
| 2,621,655 | 12/1952 | Olson | 221/232 |
| 2,950,748 | 8/1960 | Olinghowe | 221/279 |
| 2,966,280 | 12/1960 | Nelson | 221/98 |
| 3,412,897 | 11/1968 | Slater | 221/226 |
| 4,610,373 | 9/1986 | Sherbondy | 221/227 |
| 4,638,923 | 1/1987 | Mines et al. | 221/266 |
| 4,781,307 | 11/1988 | Ferro | 221/281 |

FOREIGN PATENT DOCUMENTS

| | | | |
|---|---|---|---|
| 1171839 | 1/1959 | France | 221/266 |

*Primary Examiner*—H. Grant Skaggs
*Attorney, Agent, or Firm*—M. Reid Russell

[57] ABSTRACT

A golf ball storage and dispensing device for transport in a golfer's bag that is operated to dispense, on demand, a single golf ball into a golfer's hand and consists of a tubular housing, that can be straight or cane shaped, and is for containing a column of golf balls that are supported on a spring biased platform therein to urge that column towards an open ball dispensing end of which tubular housing. A dispenser is provided across the dispensing end of the tubular housing that involves in one embodiment, a pivoting cup and, in another embodiment, a piston that is arranged to slide in a cylindrical sleeve, the piston to pickup and dispense a single golf ball when moved across the open tubular housing end. Both embodiments provide for depressing and locking the platform to load a column of golf balls therein, whereafter the platform is released, the spring biasing urging the column of golf balls against the dispenser.

7 Claims, 4 Drawing Sheets

GOLF BALL STORAGE AND DISPENSING DEVICE

BACKGROUND OF THE INVENTION

1. Field of the Invention

This invention relates to golf ball storage and dispensing devices as are maintained in a golfer's bag that operate to dispense golf balls one at a time.

2. Prior Art

Devices for storing and dispensing on demand one at a time round objects, such as golf, tennis balls, and the like, are certainly not new. A number of devices such provide for storing balls within a tube under spring biasing. One such device for dispensing balls one by one out of the top thereof is shown in a patent to Slater, U.S. Pat. No. 3,412,897. The Slater patent, like the present invention, involves a tube with a spring biased platform to urge a column of golf balls therein out of a mouth or top end. The Slater device, however, employs as a dispensing component, flexing leaves, each having an opposing shoulder that extends across the mouth or top end of a cylindrical container. The leaves are to flex outwardly when a golfer grasps a first ball in a column of balls and pulls it upwardly, against the bent shoulders, flexing the leaves apart. Distinct from the Slater patent, the present invention provides a dispensing cup, in one embodiment, that is rotated to pass a single ball out from a tubular housing end and in another embodiment provides a laterally movable head whose passage across the dispenser tube dispenses an individual ball from a tubular housing end into a golfer's hand.

Additional to the Slater patent, a number of other patents have been issued in the area of ball dispensers for both golf and tennis balls. Some examples of such are Patents to Nelson, U.S. Pat. No. 2,966,280, that shows a container that provides spring biasing of a column of tennis balls, but does not involve a dispensing mechanism like those of the present invention; and to McClure, U.S. Pat. No. 1,810,491, that shows a container with balls maintained therein under spring tensioning to urge them out of a mouth end, and includes a dispensing mechanism that consists of opposing rocker arms that pivot to pass a first ball to be pulled therefrom by a golfer operator while blocking passage of a second ball.

Additional to the above, other devices for containing a column of balls are also shown in Patents to Rodriguez, U.S. Pat. No. 4,088,251; and Pose, U.S. Pat. No. 4,253,668, that all involves gravity feed structure, with balls dispensed through a gate that is operated to guide a golf ball onto a practice tee. A salmon egg dispenser is shown in a patent Johnston, U.S. Pat. No. 2,443,861, that includes a gate arrangement that is capable of passing a single salmon egg from a column of salmon eggs, the gate moving across and picking up a single salmon egg and blocking a following egg. The arrangement of Johnston, however, requires an operator to overcome spring biasing of a piston that travels across the tube end, with release of the piston picking up a single egg from the column end. Whereas, the movable dispensing piston and sleeve of one embodiment of the present invention involves passing of an opening in the piston across the tube end, against the spring biasing, for picking up and dispensing a single golf ball.

Additional golf ball dispensing devices that involve gravity feeding of golf balls through a gate to be set on a tee or like driving support, are shown in patents to Wilson, U.S. Pat. No. 3,458,204; Hoffman, U.S. Pat. No. 4,141,558; Eberle, U.S. Pat. No. 4,391,446; Hogeberg, U.S. Pat. No. 2,696,985; and in a United Kingdom Patent No. 374,052 to Breakey. The devices of these patents are for passing a golf ball from a storage container onto a tee and involve lever type structures for selectively passing an individual ball. Further, a device known as a gleaner for gathering nuts, is shown in a U.S. Pat. No. 908,208, that includes a lever arm operated gate, this is for moving a nut into a housing and is structurally and functionally unlike the present invention.

SUMMARY OF THE INVENTION

It is a principal object in the present invention in a storage and dispensing device for carrying in a golfer's bag wherein a column of golf balls is maintained in a cylindrical housing under spring tension for dispensing a golf ball, one at a time.

Another object of the present invention is to provide a cylindrical tube as the cylindrical housing containing a movable platform that is spring biased to extend the length of which tube, with a ball dispenser arranged across the cylindrical tube end to pass a single golf ball from the tube end.

Still another object of the present invention is to provide a golf ball storage and dispensing device consisting of a tubular housing for transport in a golfer's bag, that is operated by a golfer to dispense a single golf ball from a column of balls by turning a cup arranged across the tube end or moving a piston in a sleeve across the tube end.

Still another object of the present invention is to provide a golf ball storage and dispensing device that is inexpensive to construct and that is conveniently carried in a golfer's bag for dispensing, on demand, a single golf ball from a column of golf balls maintained therein.

The present invention is in a golf ball storage and dispensing device that consists of embodiments of straight and cane shaped cylindrical tubes that are closed on one end for containing a stack of golf balls. The golf balls preferably rest on a spring biased platform arranged within the tubular housing. The platform is movable against the spring biasing from without the tubular housing and can be positioned in a locked attitude with the biasing spring compressed so as to allow a number of golf balls to be passed therein. With a stack of golf balls contained in the cylindrical tube, the platform can be released allowing a coil spring as the spring biasing to extend to urge the platform and balls resting thereon towards the tube open end.

Two embodiments of the present invention are provided that each incorporate the described tube with a spring biased platform supporting a column of balls therein. One embodiment, that has a cane shape is open at the cane down turned end with a pivoting cup fitted thereacross. The cup is pivoted by an operator. The turning cup carries a golf ball therewith that drops into the golfer's palm. In another embodiment, a sleeve is fitted across a straight tube open end, the sleeve receiving a piston telescoped therein that has an opening for admitting a single ball such that, when the piston is moved beyond the side of the tube, a golf ball contained in that piston falls back out of the opening into the golfer's hand. On release of the dispenser, a spring biasing will return the open portion of the piston back into alignment with the tube end.

The tubular housing of both embodiments of the present invention can be formed of a plastic or other flexible material, and can be colored to present a pleasing appearance. Each includes an arrangement whereby a movable platform therein can be depressed and held against spring biasing to allow feeding of a number of golf balls into the tube for use by the golfer on the golf course. The device is for fitting in the golfer's bag so as to take-up only slightly cross sectional area than that of a conventional golf ball.

BRIEF DESCRIPTION OF THE DRAWINGS

These and other objects of the present invention will become more fully apparent from the following description in which the invention is described in detail in conjunction with the accompanying drawings.

DETAILED DESCRIPTION OF THE INVENTION

Figure 1:
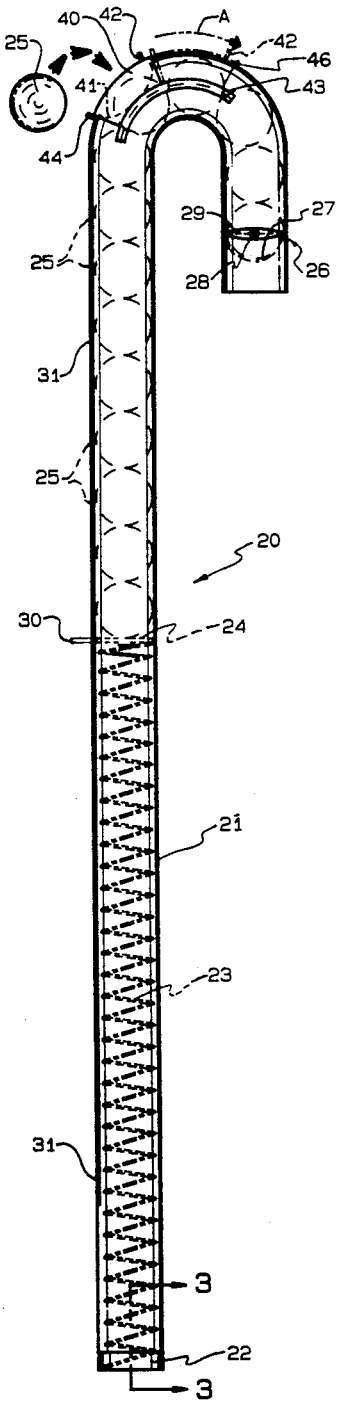
FIG. 1, shows a first embodiment of a cane shaped tubular golf ball storage and dispensing device that is closed across a bottom end and is open at the cane head end and is shown to contain a column of golf balls.

Referring now to the drawings:

A first embodiment of a golf ball storage and dispensing device 20 is shown in the side elevation view of FIG. 1, and is hereinafter referred to as dispenser 20. The dispenser 20 includes a cane shaped tube 21 as a housing, hereinafter referred to as tube, that is closed across the bottom and thereof by a cap 22 that is internally threaded and is turned onto external threads that are formed around the tube end. The tube 21, as shown in broken lines in FIG. and solid lines in FIG. 2, contains a coil spring 23 that extends from the cap 22 to the undersurface of a sliding platform 24, with a column of golf balls 25 shown supported on that sliding platform. The column of golf balls extends around the cane bend top end portion and an end golf ball 25 of the column rests in a concave or dished out portion 27 of a pivoting cup 26. Which pivoting cup 26 is shown mounted on an axle 28 that extends across and just above the open end of the tube 21. An arm 29 is shown secured to one end of axle 28, spaced apart from and parallel to the surface of tube 21, which arm is to be turned by a golfer to rotate the cup 26 through One Hundred Eighty degrees (180°). In that relation the ball 25 seated in the cup concave portion 27 will fall out from the open tube end into the golfer's hand positioned thereunder.

Figure 5:
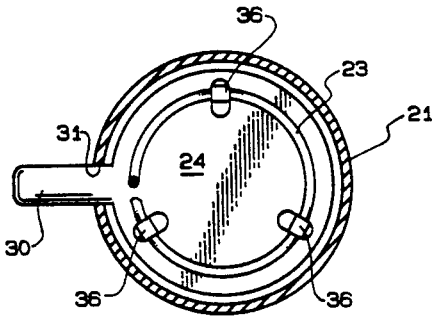
FIG. 5, is a sectional view taken along the line 5—5 of FIG. 2, showing the undersurface of a ball supporting platform.

As set out above, FIG. 1 shows the cane shaped tube 21 as containing the coil spring 23 and platform 24, with a column of golf balls maintained on that platform that have been loaded therein compressing coil 23. Which coil spring 23 end is shown in FIG. 5, secured to the undersurface of platform 24 by tabs 36 that are bent over the spring end. Shown in FIGS. 1 and 2, the coil spring 23 can be compressed by an operator moving an arm 30 of that platform along a longitudinal slot 31 that is formed in the side of tube 21, which slot 31 extends from adjacent to a ball receiving opening 41 that is formed through the tube at its One Hundred Eighty degree (180°) bend. The slot 31 guides the travel of arm 30, and includes a right angle bend end 32 at its bottom end, as shown best in FIG. 2. The right angle bend 32 is to receive the platform arm 30 moved therein and released thereby maintaining the spring 23 in a compressed attitude to allow a number of golf balls 25 to be passed therein through opening 41, as discussed hereinbelow.

Figure 2:
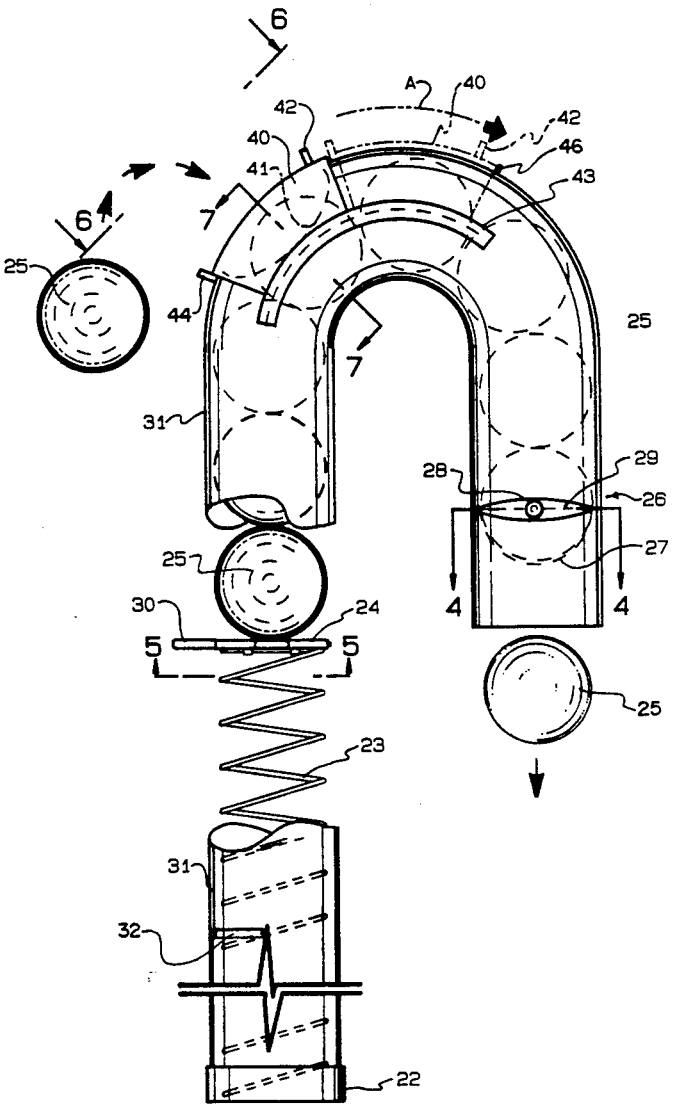
FIG. 2, is a view of the device of FIG. 1, showing both a portion and section removed to expose therein a spring biased platform with golf ball thereon and showing a port with sliding cover for loading the device with golf balls, with a golf ball shown aligned to be fed therein, and showing a dispenser that includes a pivoting dispensing cup arranged across the tube open head end.
Figure 3:
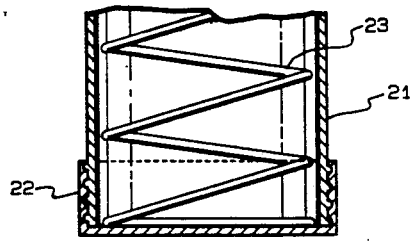
FIG. 3, shows a sectional view taken along the line 3—3 of FIG. 1.
Figure 6:
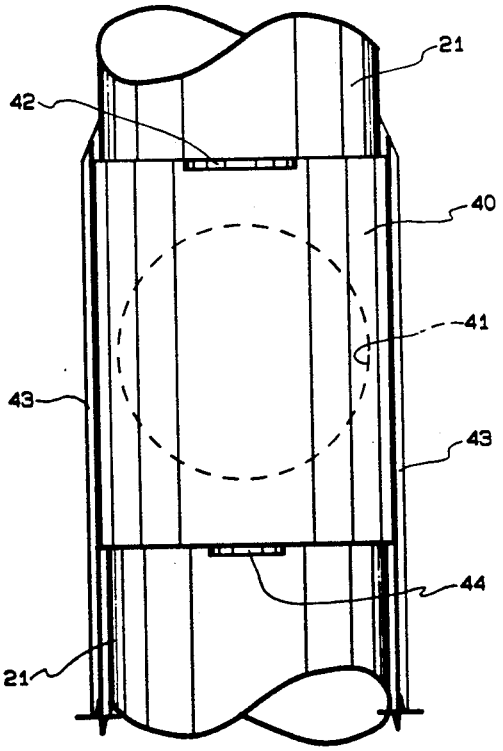
FIG. 6, is a sectional view taken along the line 6—6 of FIG. 2 of the sliding cover.
Figure 7:
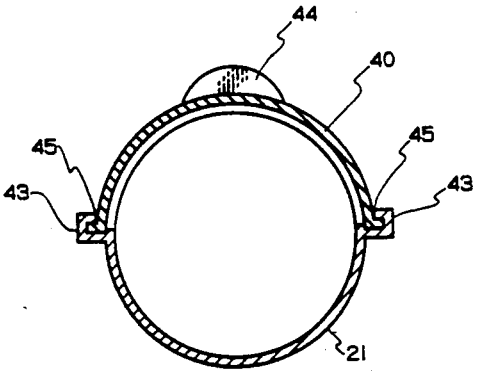
FIG. 7, is a sectional view taken along the line 7—7 of FIG. 2 of the tube and sliding cover.

The cane shaped tube 21, as shown best in FIGS. 1 and 2, is curved into a U-shape at the head end. For golf ball 25 loading, as shown best in FIGS. 6 and 7, a sliding gate 40 is arranged to slide across opening 41, as shown by arrow A, from an opening covered attitude to an uncovered attitude where golf balls 25 can be fitted through opening 41. Prior to which loading the platform 24 will have been depressed by moving arm 30 along slot 31 and into the right angle slot 32. To provide for gate 40 movement, a tab 42 is provided that extends at a right angle outwardly to the gate surface for engagement by an operator's finger to move the gate to the broken line attitude shown in FIG. 1. In which attitude, the opening 41 is uncovered. To facilitate this travel, as shown best in FIG. 7, gate edges are bent outwardly into flanges 45 that are for fitting to slide along hook shaped tracks 43 that are formed to extend outwardly from opposite edges of the opening 41. Gate 40 travel back over opening 41 is restricted by a stop 44 that extends from the tube wall at the end of opening 41. A forward stop 46 mounted to the tube, spaced forward from the opening 41 by the length of the gate 40, for stopping gate travel when it is moved to an opening 41 uncovered attitude. So arranged, with the platform maintained as described above, compressing the spring 23, a column of golf balls 25 can be loaded through opening 41 into tube 21, storing that column of golf balls for later use by a golfer.

Figure 4:
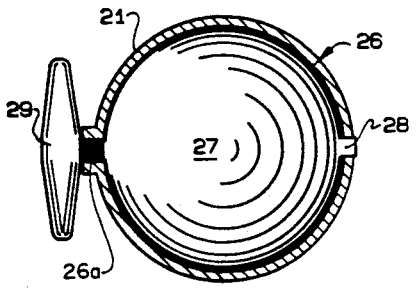
FIG. 4, is a top plan sectional view taken along the line 4—4 of FIG. 2, showing the pivoting dispensing cup of the dispenser.

FIG. 4, shows a top plan view of the end of tube 21 where across a cup 26 is pivotally arranged that includes a dished out or concave portion 27 that is to receive a golf ball captured therein. The cup is pivotally mounted at a point on its edge by a pivot 28 that extends from the cup edge with a threaded shaft 26a extending from its opposite edge whereon a pivot mount pivot arm 29, extending across the tube side is turned, completing the pivot mount. The cup concave or dished out portion 27 is for receiving a golf ball 25 seated therein and the pivot arm 29 is for turning, by an operator, the cup 26 through One Hundred Eighty degrees (180°) to dispense a single ball out from the tube open end, as shown best in FIGS. 1 and 2.

Figure 8:
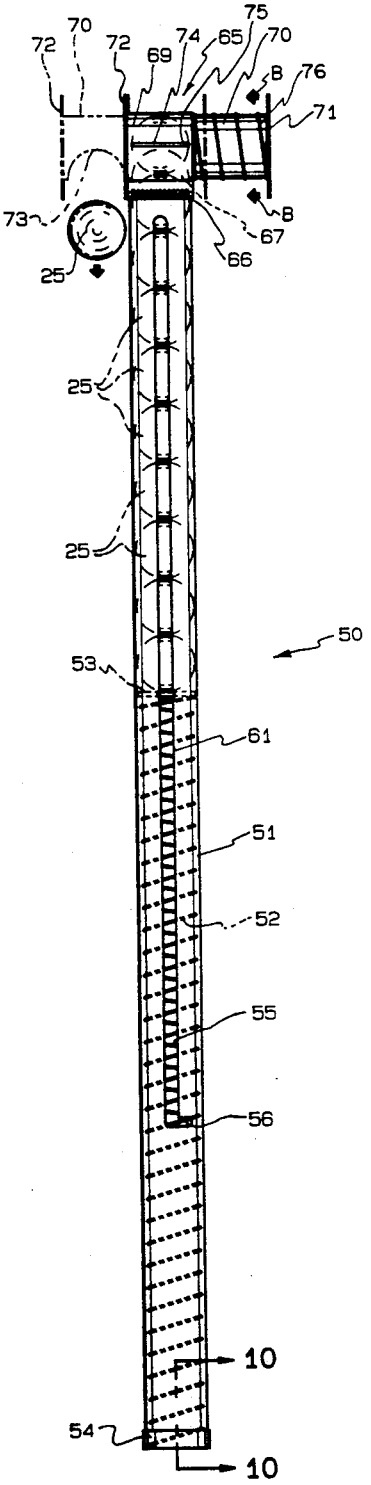
FIG. 8, is a side elevation view like that of FIG. 1 of a second embodiment of the present invention in a golf ball storage and dispensing device, showing a column of golf balls therein and showing, in broken lines, a golf ball being dispensed from a dispenser head thereof.
Figure 9:
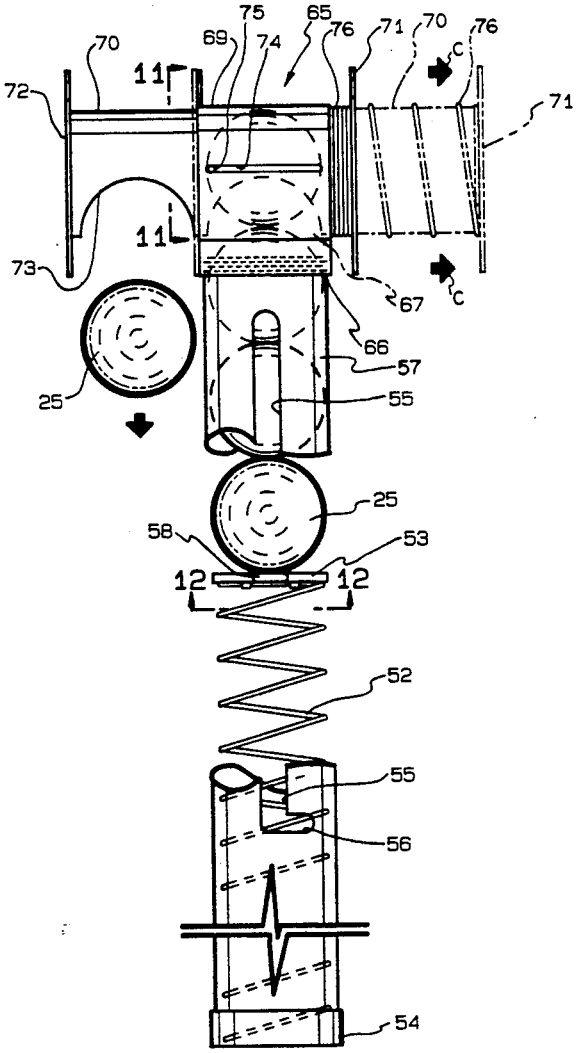
FIG. 9, is a view of the device of FIG. 8, showing both a portion and section removed to expose a platform and spring biasing therefore with a column of golf balls shown seated on the platform and showing a golf ball being dispensed from a dispensing head thereof.
Figure 10:
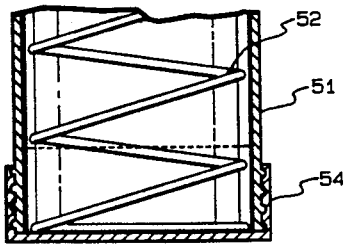
FIG. 10, is a side elevation sectional view taken along the line 10—10 of FIG. 8.

FIGS. 8 through 12, show another embodiment of a golf ball storage and dispensing device 50, hereinafter referred to as dispenser. As shown best in FIG. 8, dispenser 50, like dispenser 20, involves a long cylindrical tube 51 that has a circular cross section with an internal diameter that is sufficient to accommodate the stack of golf balls 25 slidably fitted therein. The tube 51 is closed across one end by a cap 54 that, as shown best in FIG. 10, is internally threaded for turning onto threads that are formed around the tube end. Of course, both the cap 54 and cap 22 of dispenser 20 could be secured thereto as by gluing within the scope of this disclosure. The cap 54 provides a seat for one end of a coil spring 52, that, as shown best in FIG. 8, extends the length of the tubular housing 53 and connects to an undersurface of a platform 53 by tabs 57 that are bent thereover, as shown best in FIG. 12. Shown in FIGS. 8, 9 and 12, the platform 53, like the platform 24, includes an outwardly extending arm 58 for travel in a longitudinal slot 55, that extends from approximately the tube 51 top end to above its bottom end, the lower end of which slot has a right angle section 56 formed therein. The arm 58 is for travel within the slot 55, compressing the spring 52 as it is moved from the top to the bottom of the slot. Whereat the arm 58 is moved into right angle slot section 56, locking platform 53 and the spring 52 in a loading attitude.

With the platform 53 positioned as described above, golf balls 25 can be loaded into the tubular housing 51, from an open top end therefore. To provide this loading, a top dispensing head 65 that is for installation to the tube 51 open end is internally threaded at 67 around a cylindrical neck 66, as shown in broken lines. The threads 67 formed around the inside of the collar 66 are compatible to turn onto threads 68 that are formed around the tube 51 end, as shown best in FIG. 11. So arranged, the dispensing head 65 can be conveniently turned onto and off of the open top end of tube housing 51, to the attitudes shown in FIGS. 8, 9 and 11.

Figure 11:
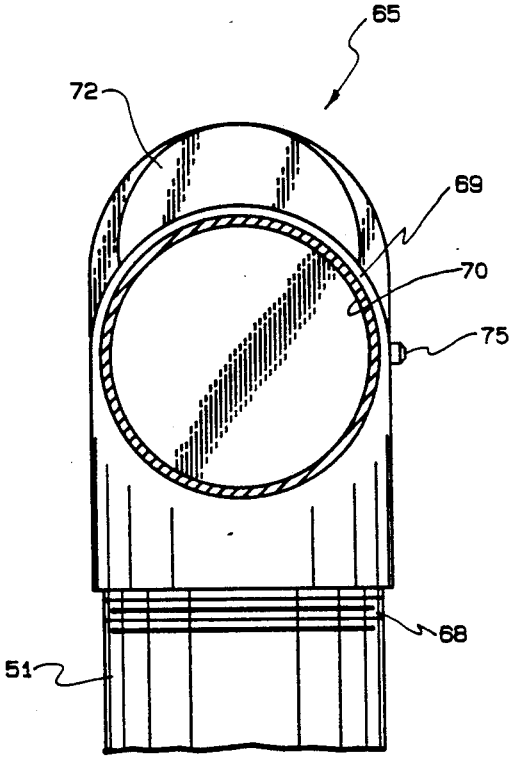
FIG. 11, is a side elevation sectional view of the golf ball dispensing head of FIG. 8.
Figure 12:
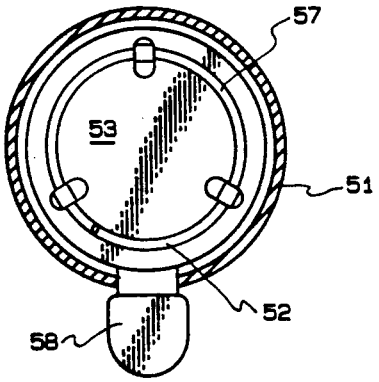
FIG. 12, is a bottom plan sectional view taken along the line 12—12 showing the undersurface of a sliding ball supporting platform of FIG. 9.

Dispensing head 65, as shown best in FIGS. 8, 9 and 11, includes a sleeve 69, the collar 66 extending from the side thereof at a right angle. Sleeve 69 is to receive a piston 70 that is telescoped therethrough, which piston 70 has an end cap 71 attached across one end thereof, is fitted through the sleeve 69, and extends beyond cylinder with a plate 72 secured over its opposite end. The piston 70 is thereby arranged to slide back and forth in cylinder 69. Piston 70, as shown best in FIG. 2, includes a circular opening 73 that is formed through its side wall such that, with the piston 70 in the attitude shown in FIG. 8, a top golf ball 25, in the column of golf balls, will pass through the circular opening 73 and into the piston 70. Thereafter, when the piston 70 is moved in sleeve 69 across the tube 51 end, that captured golf ball 25 will remain in the opening 73. The piston 70 is thereby moved in the attitude shown in FIG. 9, whereat the golf ball will fall from the piston into a golfer's hand held therebelow.

To guide piston 70 travel across the tube 51 end, a longitudinal slot 74 is provided in the sleeve 69 and a pin 75 is fitted to extend from the piston wall and is fitted in the slot 74, as illustrated best in FIGS. 9 and 11. The pin 75 both guides piston 70 and limits its travel along the sleeve 69. Which piston 70 travel is also limited by contact of the piston end cap 71 and end plate 72 with the cylinder 69 ends. In practice, piston 70 can be a solid unit with the opening 73 arranged as a cup therein to receive and carry the golf ball during piston travel. Or, as illustrated in FIG. 11, piston 70 can be a tube in the opening 73 for passing the single golf ball 25 into the piston and then moving it to beyond the tube 51 surface. The golf ball remaining in the tubular piston to fall out from the opening 73 when the dispenser is tipped appropriately from the vertical towards the ball dispensing side, aligning the golf ball within the piston 78 with the opening 73, as illustrated in FIG. 9.

Preferably, spring biasing that is shown in FIGS. 8 and 9, as a coil spring 76 with piston 70 telescoped therethrough, which coil spring biases piston 70 to a golf ball loading attitude, and which spring biasing is overcome, as illustrated by arrows B in FIG. 8, to move piston 70 across the tube 51 open top end 60 to the attitude shown in FIG. 9, by an operator pushing on end cap 71. After release of which end cap 71, the coil spring 76 returns the piston to the broken line attitude shown in FIG. 9, as illustrated by arrows C.

The above set out embodiments of devices 20 and 50, are preferred configurations of the present invention in a golf ball storage and dispensing device. Each provides for storing a column of golf balls in a tubular housing that includes a platform that is spring biased to move the column of golf balls against a dispenser end of the tubular housing. Which tubular housing has been shown as either being a straight tube or a tube that is bent into a cane shape. It should, however, be understood that other configurations of tubular housings could be used within the scope of this disclosure. Also, the preferred tubular housing is formed from a plastic that can be colored or made of a transparent material within the scope of this disclosure. It should, however, be understood that the tubular housing could also be made of metal or the like.

Hereinabove, has been set out and described two embodiments of the present invention in a golf ball storage and dispensing device. It should, however, be understood that the present disclosure is made by way of example only and that variations and modifications thereto are possible within the scope of this disclosure without departing from the subject matter coming within the scope of the following claims and reasonable equivalency thereof, which claims I regard as my invention.

I claim:

1. A golf ball storage and dispensing device comprising, a straight cylindrical tube for containing a column of golf balls, which straight cylindrical tube is closed on one end and is open at the other; platform means arranged to slide within said straight cylindrical tube under the urgings of spring biasing means and including means for moving said platform means against said spring biasing means; and a means for passing a number of golf balls into said straight cylindrical tube onto said platform means that is also a means for dispensing one at a time, golf balls from said straight cylindrical tube open end and consists of a sleeve whereto is secured, at a right angle a collar, that opens into said sleeve and is arranged for mounting over the open end of the straight cylindrical tube, and a piston means for movement in said sleeve, to travel across the open end of said collar and straight cylindrical tube, said piston means including means for receiving a golf ball when positioned opposite to said straight cylindrical tube open end and for dispensing said golf ball therefrom when said piston is moved in said sleeve to where said means for receiving a golf ball is beyond the side of said straight cylindrical tube.

2. A golf ball storage and dispensing device as recited in claim 1, wherein the spring biasing means is a coil spring that is maintained between the cylindrical tube closed end and the platform means; and the means for moving said platform means is an arm that extends outwardly from said platform means and is fitted to move in a longitudinal slot formed in the side of said cylindrical tube, which said longitudinal slot includes a right angle bend at the end thereof that is proximate to said cylindrical tube closed end.

3. A golf ball storage and dispensing device as recited in claim 1, wherein the piston means is spring biased in the sleeve to where the means for receiving a golf ball is normally opposite to the open end of said cylindrical tube; and the piston means is a tube that is closed at both ends and has a circular opening through the side thereof as the means for receiving a golf ball, which circular opening will be beyond the side of the cylindrical tube when the piston is moved to a limit of travel against said spring biasing.

4. A golf ball storage and dispensing device as recited in claim 3, wherein the piston is closed on both ends by plates each having a greater diameter than that of the sleeve diameter; and the spring biasing is a coil spring that is fitted around said piston between one end plate and the sleeve end to bias said piston to where the circular opening is opposite to the cylindrical tube open end.

5. A golf ball storage and dispensing device as recited in claim 4, further including means for guiding the piston travel in the sleeve that consists of a pin that extends outwardly from the outside surface of said piston, which pin is fitted into a longitudinal slot that is formed in said sleeve, across the sleeve collar.

6. A golf ball storage and dispensing device comprising, a cane shaped cylindrical tube for containing a column of golf balls, which cylindrical tube is closed on one end and is open at the other cane head end; platform means arranged to slide within said cylindrical tube under the urgings of spring biasing means and including means for moving said platform means against said spring biasing means; an opening formed through the cane head end of said cylindrical tube with gate means arranged for closing off said opening for passing a number of golf balls into said cylindrical tube onto said platform means; and a cup that has a concave portion to receive a golf ball seated therein, and pivot means for mounting said cup across the cylindrical tube cane head open end to allow said cup to rotate to where the cup concave portion is across the cylindrical tube cane head open end such that a golf ball seated therein will fall from that cup.

7. A golf ball storage and dispensing device as recited in claim 6 wherein a right angle arm is mounted to the cup pivot means to rotate said cup when turned.

* * * * *